United States Patent [19]

Edwards

[11] 4,244,400

[45] Jan. 13, 1981

[54] HAND WEAVING LOOMS

[76] Inventor: Jack N. Edwards, Box 777, El Rito, N. Mex. 87530

[21] Appl. No.: 38,198

[22] Filed: May 11, 1979

[51] Int. Cl.[3] ..... D03D 29/00

[52] U.S. Cl. ..... 139/33

[58] Field of Search ..... 139/29–33

[56] References Cited

U.S. PATENT DOCUMENTS

| | | | |
|---|---|---|---|
| 2,380,233 | 7/1945 | Greenwood | 139/33 |
| 3,774,649 | 11/1973 | Glessner | 139/33 |

FOREIGN PATENT DOCUMENTS

| | | | |
|---|---|---|---|
| 2381849 | 2/1977 | France | 139/33 |

*Primary Examiner*—Henry Jaudon

[57] ABSTRACT

A shedding mechanism for a foot treadled hand loom is disclosed. The mechanism insures ease of operation and uniform shed formation. Harness motion is always parallel to the original harness position, and each harness moves further than the one in front of it to cause all warp threads to open to the same angle at the front of the loom.

3 Claims, 7 Drawing Figures

HAND WEAVING LOOMS

It is the objective of this invention to provide a mechanism which will form an entirely uniform shed in a foot treadled, hand weaving loom. To accomplish this, the invention has the following characteristics: A plurality of harnesses which may be moved independently, either up or down. Each harness is constrained so that its motion is always parallel to its original horizontal position, and cannot be tilted from end to end. Each harness opens further than the harness in front of it so that the shed is formed at the front of the loom with all of the warp threads opened to a uniform angle, regardless of which harness a wrap thread is threaded through. The foot treadles are pivoted at the rear of the loom to provide superior mechanical advantage.

The preferred embodiment of the invention is illustrated in the accompanying drawings, in which.

Figure 1:
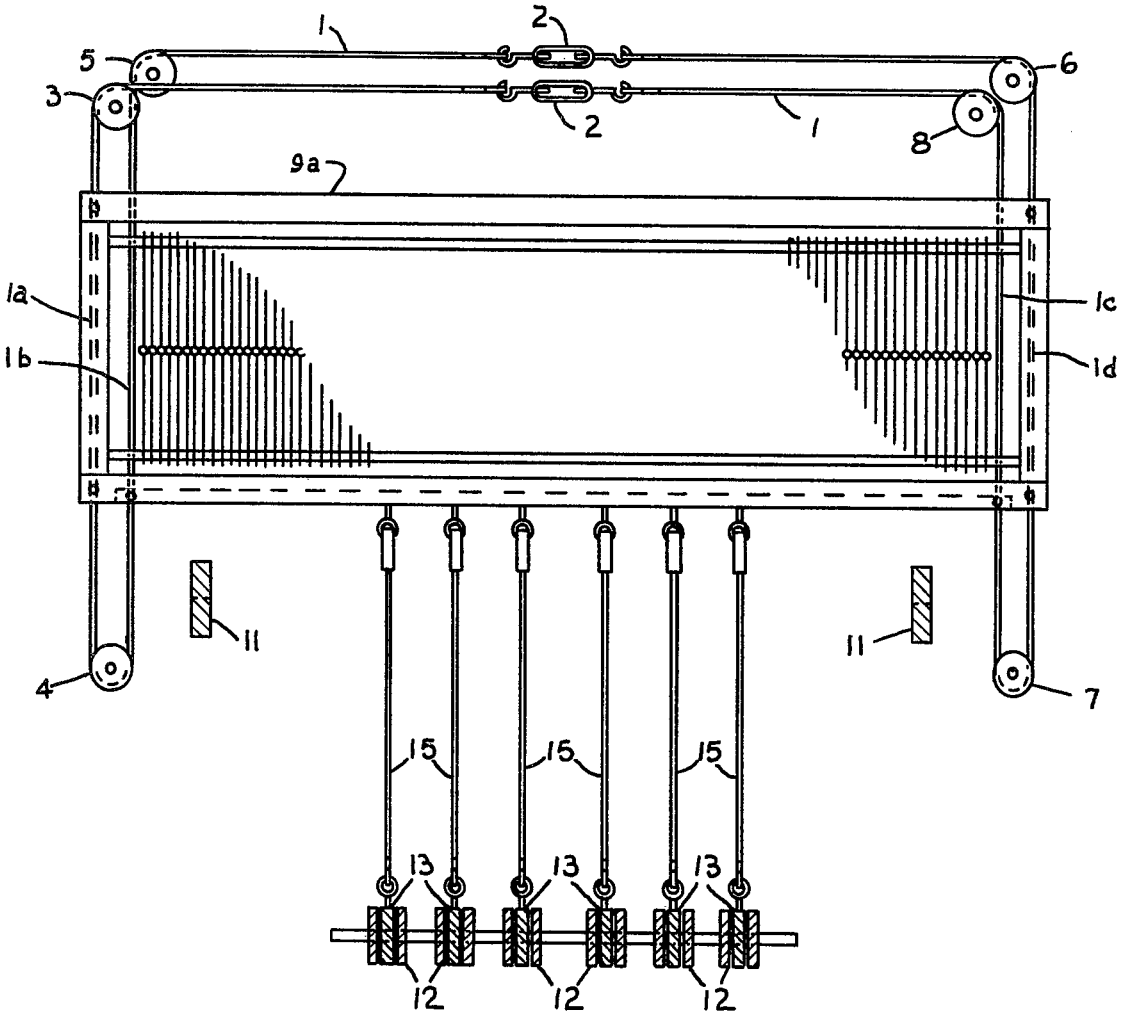
FIG. 1 is a partial front view showing the shedding mechanism and the treadles; the main structure of the loom is not shown.
Figure 2:
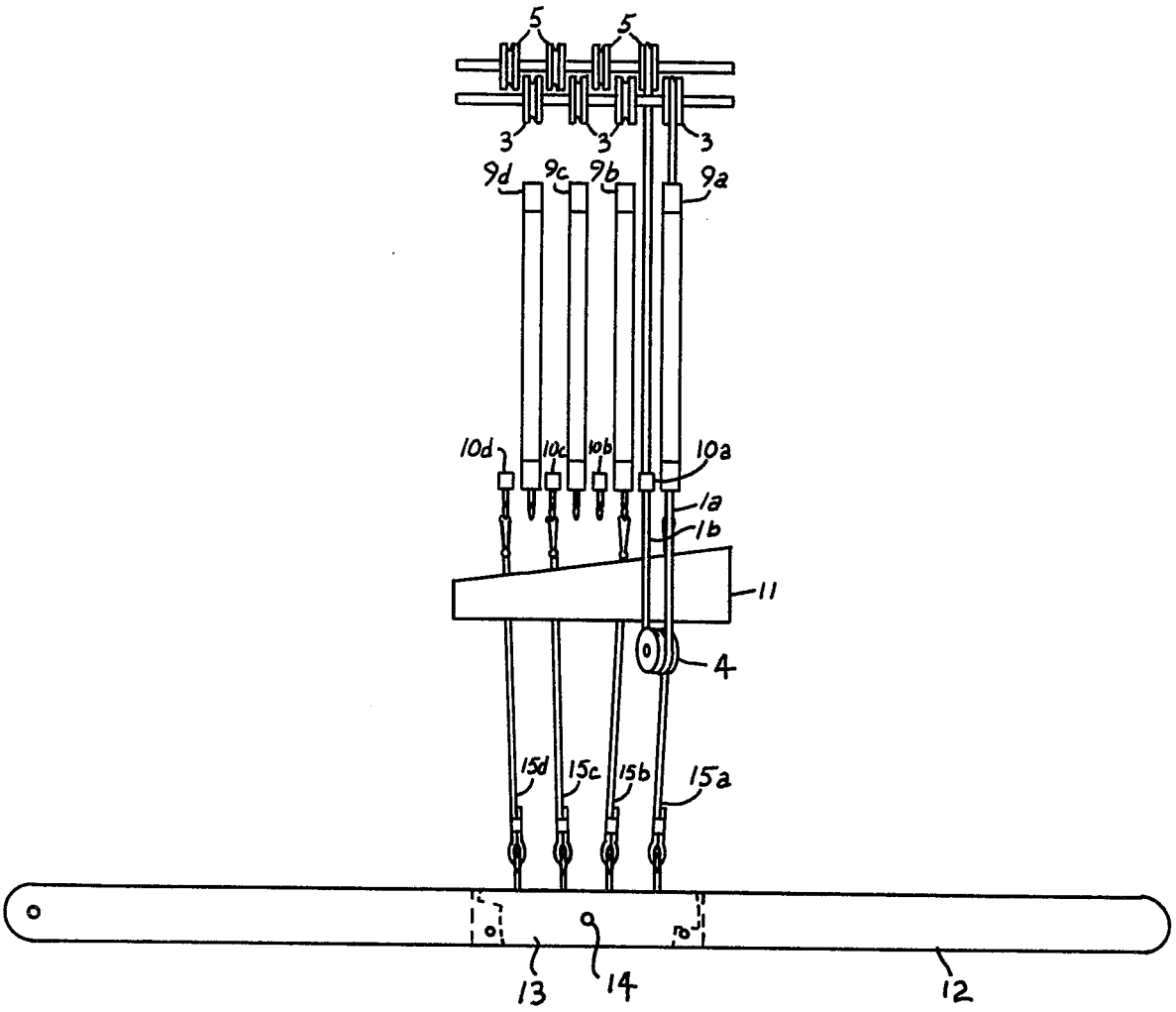
FIG. 2 is a partial left side view.
Figure 3:
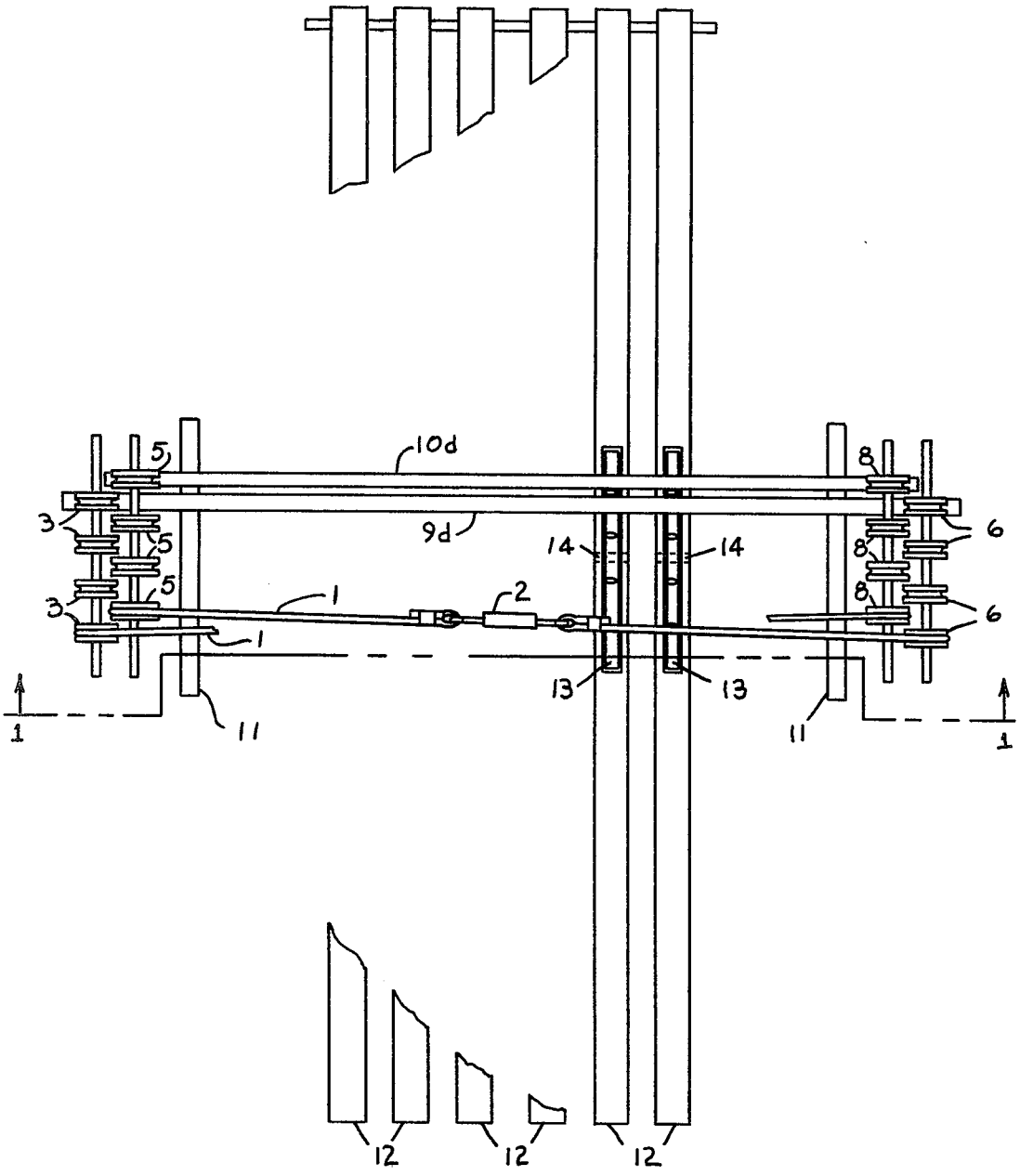
FIG. 3 is a partial top view.

Referring to FIGS. 1, 2, and 3 the following is a description of the invention and its principles of operation. The first elements are a plurality of continuous or essentially continuous, taut cables 1. Tension is maintained by turnbuckles 2. Each cable 1 is supported on six pulleys 3, 4, 5, 6, 7, 8. The pulleys 3–8 are arranged so that the cable 1 has two vertical runs 1*a* and 1*b*, and 1*c* and 1*d* on each side of the loom. With this arrangement, it can be seen that if any point on the continuous cable 1 is moved all points on the cable 1 move. Further, that on each side of the loom one vertical run 1*a* and 1*d* will move up (or down), and that on each side one vertical run 1*b* and 1*c* will move in the opposite direction. To each of the plurality of cables 1 is attached a normal harness frame 9*a*, 9*b*, 9*c*, or 9*d*. Each harness 9*a*, 9*b*, 9*c*, or 9*d* is connected to a vertical run of the cable 1*a* and 1*d* on each side of the loom. To the other two vertical cable runs 1*b* and 1*c* is attached an idler bar 10*a*, 10*b*, 10*c*, or 10*d*. With this arrangement, if the idler bar 10*a*, 10*b*, 10*c*, or 10*d* is pulled down the harness 9*a*, 9*b*, 9*c*, or 9*d* will rise, and if the harness 9*a*, 9*b*, 9*c*, or 9*d* is pulled down the corresponding idler bar 10*a*, 10*b*, 10*c*, or 10*d* will rise. In addition, by this arrangement of the continuous taut cable 1, the motion of the harnesses 9*a*, 9*b*, 9*c*, and 9*d* and the idler bars 10*a*, 10*b*, 10*c*, and 10*d* is always parallel to their original positions. That is, the harnesses 9*a*, 9*b*, 9*c*, and 9*d* and the idler bars 10*a*, 10*b*, 10*c*, and 10*d* are constrained to operate parallel and cannot be tilted with one end lower than the other.

Beneath the harnesses 9*a*, 9*b*, 9*c*, and 9*d* and idler bars 10*a*, 10*b*, 10*c*, and 10*d* on each side of the loom is a harness-and-idler-bar stop 11. The stops 11 are placed a distance below the harnesses 9*a*, 9*b*, 9*c*, and 9*d* and the idler bars 10*a*, 10*b*, 10*c*, and 10*d*. The distance corresponds to the desired full travel of the harnesses 9*a*, 9*b*, 9*c*, and 9*d* in the open shed position. The top surface of the stops 11 is angled so that the rear harness 9*d* can move further than the front harness 9*a*, and the intermediate harnesses 9*b* and 9*c* can move intermediate distances. The angle on the stops 11 is selected so that the shed is formed at the front of the loom with all the warp threads opened to a uniform angle regardless of which harness 9*a*, 9*b*, 9*c*, or 9*d* a warp thread is threaded through.

Beneath the harnesses 9*a*, 9*b*, 9*c*, and 9*d* are located a plurality of treadles 12, pivotally mounted at the rear of the loom. The rear mounting provides superior mechanical advantage to operate the harnesses 9*a*, 9*b*, 9*c*, and 9*d*. The rear mounting of the treadles 12, however, if connected directly to the harnesses 9*a*, 9*b*, 9*c*, and 9*d* would cause the front harness 9*a* to move further than the rear harness 9*d*; this would be in direct opposition to the function of the angled stops 11. To correct this, a treadle compensator 13 is pivotally mounted in the center of each treadle 12 on a treadle compensator axle 14, the operation of which is explained below. Attached to each treadle compensator 13 is a plurality of connecting cords 15. There are as many connecting cords 15 on each treadle compensator 13 as there are harnesses 9*a*, 9*b*, 9*c*, and 9*d*. Depending on the weaving pattern desired, if a harness 9*a*, 9*b*, 9*c*, or 9*d* is to rise when a certain treadle 12 is pressed, the connecting cord 15*a*, 15*b*, 15*c* or 15*d* for that harness 9*a*, 9*b*, 9*c*, or 9*d* is connected to the corresponding idler bar 10*a*, 10*b*, 10*c*, or 10*d*. If a particular harness 9*a*, 9*b*, 9*c*, or 9*d* is to fall when a specific treadle is pressed, then the connecting cord 15*a*, 15*b*, 15*c*, and 15*d* is connected directly to that harness 9*a*, 9*b*, 9*c*, or 9*d*. As an example in FIG. 2, connecting cord 15*a* is connected to harness 9*a*, connecting cord 15*b* is connected to harness 9*b*, connecting cord 15*c* is connected to idler bar 10*c*, and connecting cord 15*d* is connected to idler bar 10*d*. When this treadle 12 is pressed, harnesses 9*a* and 9*b* will fall and harnesses 9*c* and 9*d* will rise. As any treadle 12 is pushed, the motion of the harnesses 9*a*, 9*b*, 9*c*, and 9*d* continues until harness 9*a* or idler bar 10*a* comes to rest against the stops 11. At this point, the other harnesses 9*b*, 9*c*, and 9*d* or the other idler bars 10*b*, 10*c*, and 10*d* are still not against the stops 11. As the treadle is depressed further, the treadle compensator 13 pivots on the treadle compensator axle 14 and harnesses 9*b*, 9*c*, and 9*d* continue to move. Each harness 9*b*, 9*c*, and 9*d* are moving further than the one in front of it. The harness motion continues thusly until the harnesses 9*b*, 9*c*, and 9*d* or their idler bars 10*b*, 10*c*, and 10*d* come to rest simultaneously against the stops 11. In their final positions each harness 9*a*, 9*b*, 9*c*, or 9*d* has traveled further than the one in front of it, a predetermined amount, so that the shed is opened to a uniform angle.

Figure 4:
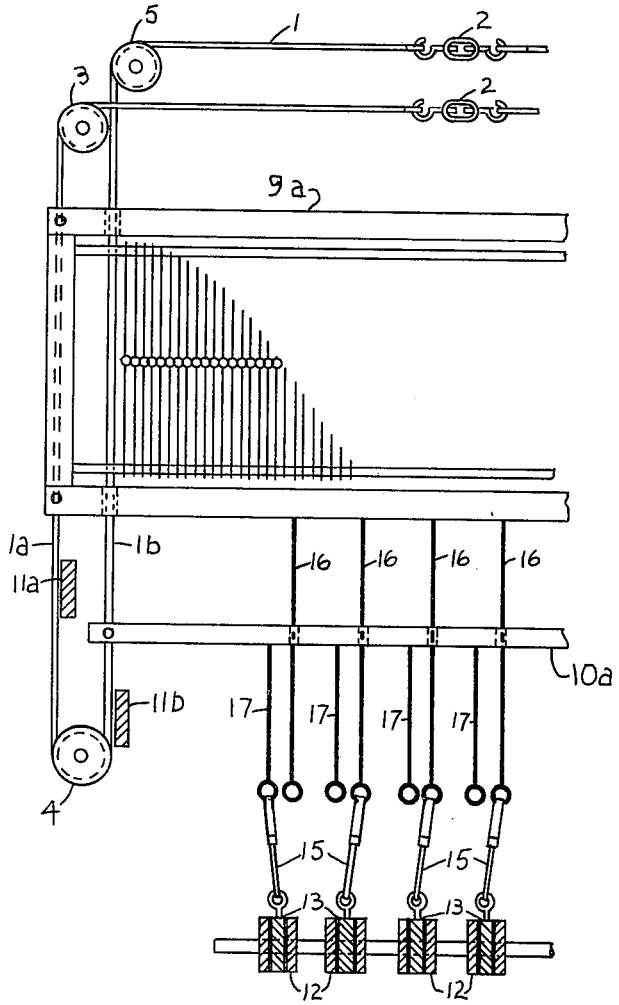
FIG. 4 is a partial, front view of the first alternate embodiment of the invention.
Figure 5:
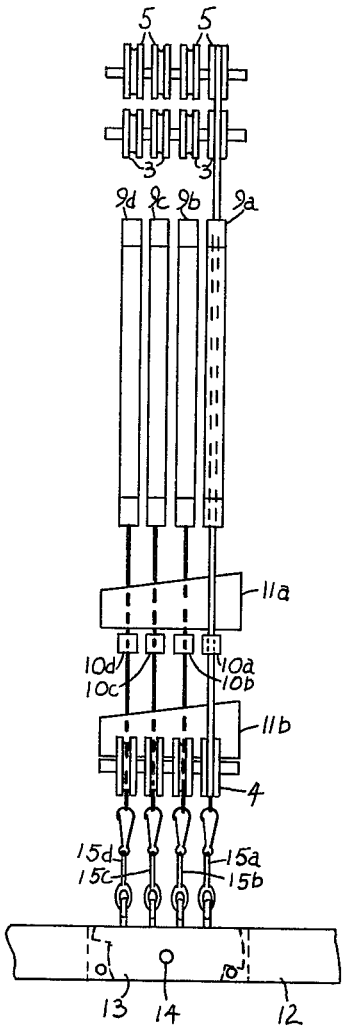
FIG. 5 is a partial, left side view of the first alternate embodiment of the invention.

FIGS. 4 and 5 show an alternate embodiment of the basic invention. The principal difference from the preferred embodiment is that the idler bars 10 have been moved from behind each harness 9 to below each harness 9. This allows a more compact arrangement of the harnesses 9 but requires a more complex arrangement of the tie up cords 15, 16, and 17.

Referring to FIGS. 4 and 5 the harnesses 9 and the idler bars 10 are mounted in pairs to a continuous cable 1 as specified for the preferred embodiment, except that the cables 1 and the pulleys 3, 4, 5, 6, 7, 8, are mounted all in one plane. Cable run 1*b* (FIG. 4) and cable run 1*c* (not shown) pass freely through the harnesses 9. The idler bars 10 are shorter than the harnesses 9 and located below the harnesses 9, a distance sufficient so that when a harness 9 moves down and the corresponding idler bar 10 moves up they do not collide before the motion is arrested by the harness stops 11*a* or the idler bar stops 11*b*.

There are two pairs of stops, the harness stops 11*a* and the idler bar stops 11*b*. The harness stops 11*a* are located an appropriate distance below the harnesses 9 so that when the harnesses 9 come to rest against the harness stops 11*a* the harnesses 9 are in the full lowered position. The second pair of stops called the idler bar stops 11*b* are located below the idler bars 10 so that when the idler bars 10 come to rest against the idler bar stops 11*b* the harnesses 9 are in the full raised position. The top surfaces of both pairs of stops 11*a*, 11*b* are angled as discussed previously in the specifications for the preferred embodiment.

Tie up of the harnesses 9 and the idler bars 10 is affected through tie up cords 15, 16, 17. Harness cords 16 are connected to each harness 9, one harness cord 16 on each harness 9, for each treadle 12. The harness cords 16 pass freely though the idler bars 10. Idler bar cords 17 are shorter and connected to each idler bar 10, one idler bar cord 17 on each idler bar 10, for each treadle 12. Treadle 12, treadle compensators 13, and connecting cords 15 are as specified for the preferred embodiment.

To select a weaving pattern the cords 15 are connected to either the harness cords 16, to cause the harness 9 to fall, or the cord 15 is connected to the idler bar cord 17 to cause the harness 9 to rise.

When a tradle 12 is depressed all the harnesses 9 which are connected to the treadle 12, with harness cords 16, will fall and all the harnesses 9 that are connected to that treadle 12 with idler bar cord 17, will rise. This motion will continue until the front harnesses 9*a* or the front idler bars 10*a* comes to rest against the harness stops 11*a*, or the idler bar stops 11*b*. At this point the treadle compensator 13 begins to operate as specified for the preferred embodiment. The harnesses 9 come to rest with the rear harnesses 9 open further than the front harnesses 9, some harnesses 9 raised, some lowered, as determined by the tie up.

Figure 6:
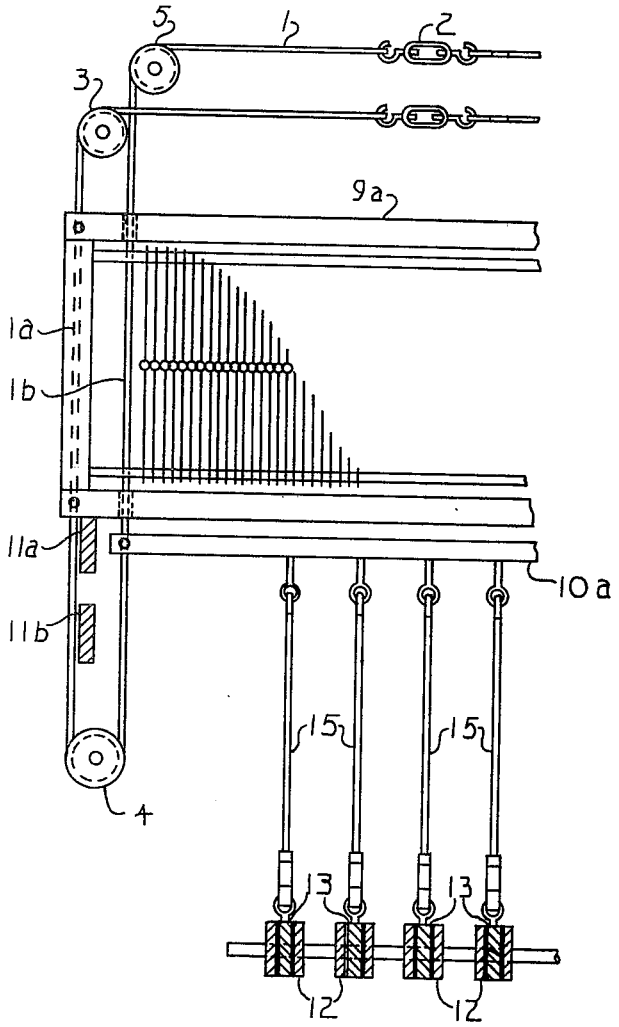
FIG. 6 is a partial, front view of the second alternate embodiment of the invention.
Figure 7:
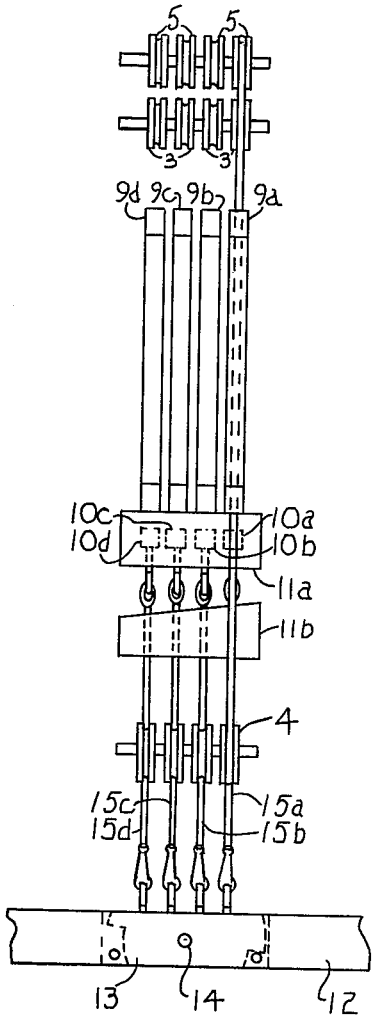
FIG. 7 is a partial, left side view of the second alternate embodiment of the invention.

FIGS. 6 and 7 show a third embodiment of the basic invention. The prncipal difference is that the operation of the harnesses is a rising shed only (jack loom). This is the simplest and most compact arrangement of the components.

Referring to FIGS. 6 and 7 the harnesses 9 and the idler bars 10 are mounted in pairs to a continuous cable 1 as discussed before. The cable 1 and the pulleys 3, 4, 5, 6, 7, 8 may all be in one plane as shown in FIGS. 6 and 7 or out of plane as specified in the preferred embodiment. The idler bars 10 are shorter than the harnesses 9 and are located below the harnesses 9.

Harness stops are located directly below the harnesses 9 and are not angled so that the harnesses 9 rest on the harness stops 11*a*, all at the same height. The idler bar stops 11*b* are located a distance below the idler bars 10 so that when the idler bars 10 come to rest against the idler bar stops 11*b* the harnesses 9 will be in the raised position.

Treadles 12 and treadle compensators 13 are as specified for the preferred embodiment. Connecting cords 15 are attached to each idler bar 10, one for each treadle 12.

To select a weaving pattern the cords 15, on an idler bar 10 corresponding to a selected harnesses 9 are connected to the desired treadle 12. When that treadle 12 is depressed the harness 9 will rise. Harnesses 9 that are to remain stationary when a treadle 12 is depressed are not connected to that treadle 12. When a treadle 12 is pushed, harnesses 9 connected to that treadle 12, through the corresponding idler bar 10 and connecting cord 15, will rise. The other harnesses 9 will remain at rest. When the first idler bar 10 contacts the idler bar stops 11*b* it will stop. The other harnesses which are rising will continue to rise under the action of the treadle compensator 13, as specified for the preferred embodiment.

Thus, according to the objectives, this invention has:

A. A plurality of harnesses which can be operated independently, either up or down.

B. A uniform shed is formed since:

B. 1. There is no variation in the shed across the width of the loom because the cables constrain the motion of the harnesses to be parallel to their original positions.

B. 2. There is no variation in the angle different warp threads are opened to, regardless of which harness it is threaded through. This is because of the action of the treadle compensators and the harness-and-idler-bar stops.

C. Foot treadles which are pivoted to the rear of the loom.

According to the provisions of the patent statutes, I have explained the principles of my invention and have illustrated and described what I consider its best embodiment. However, I desire to have it understood that within the scope of the claims, the invention may be practiced otherwise than as specifically illustrated and described.

I claim:

1. A shedding mechanism in a foot treadled, hand weaving loom, comprised of: a plurality of continuous or essentially continuous cables, moveably supported on fixed pulleys; the pulleys arranged so that two runs of the cable are aligned vertically on each side of the loom, and said vertical runs move in opposite directions on each side of the loom when the cable is moved; a plurality of harness frames, each fixedly attached to a vertical run of each cable on each side of the loom, such that each harness will move freely up or down and remain parallel to its original horizontal position; a plurality of idler bars, each located beside a harness frame, and each fixedly attached to a vertical run of each cable on each side of the loom, such that each idler bar moves up or down in the opposite direction to the harness which is attached to the same cable; a pair of harness-and-idler-bar stops, located an appropriate distance below the harnesses and with the top surface of the stops angled, so that when the harnesses or idler bars come to rest against the stops, the harnesses are in the full open position, with the rear harnesses open further than the front harnesses, an amount determined by the angle on the stops; a plurality of treadles pivotally mounted at the rear of the loom and located beneath the harnesses; a treadle compensator, pivotally mounted on each treadle directly beneath the harnesses and idler bars; connecting cords, selectively connecting each treadle compensator to each harness or its idler bar, such that when a selected treadle is depressed, the harnesses will rise or fall, as determined by the tie-up, and come to the full open position.

2. A shedding mechanism in a foot treadled, hand weaving loom, comprised of: a plurality of continuous or essentially continuous cables, moveably supported on fixed pulleys; the pulleys arranged so that two runs of the cable are aligned vertically on each side of the loom, and said vertical runs move in opposite directions on each side of the loom when the cable is moved; a plurality of harness frames, each fixedly attached to a vertical run of each cable on each side of the loom, such that each harness will move freely up or down and remain parallel to its original horizontal position; a plurality of idler bars, which are shorter than the harnesses, each located beneath a harness, allowing the harnesses to be spaced closely together, the idler bars being sufficiently below the harnesses to allow operation as subsequently described, each idler bar fixedly attached to a vertical run of each cable on each side of the loom, such that each idler bar moves up or down in the opposite direction to the harness which is attached to the same cable; two pairs of harness-and-idler-bar stops, the first pair of stops being located an appropriate distance below the harnesses, so that when the harnesses come to rest against the stops the harnesses are in the full lowered position; the second pair of stops being located an appropriate distance below the idler bars, so that when the idler bars come to rest against the stops the harnesses are in the full raised position, the idler bars being shorter than the spacing between the first pair of stops, so that the idler bars can pass between the first pair of stops; the top surfaces of both pairs of stops being angled so that when the harnesses or idler bars come to rest against the stops the harnesses are in the full open position, with the rear harnesses open further than the front harnesses, an amount determined by the angle on the stops; a plurality of treadles, pivotally mounted at the rear of the loom and located beneath the harnesses; a treadle compensator, pivotally mounted on each treadle directly beneath the harnesses and idler bars; connecting cords, selectively connecting each treadle compensator to each harness or its idler bar, such that when a selected treadle is depressed, the harnesses will rise or fall, as determined by the tie-up, and come to the full open position.

3. A shedding mechanism in a foot treadled, hand weaving loom, comprised of: a plurality of continuous or essentially continuous cables, moveably supported on fixed pulleys; the pulleys arranged so that two runs of the cable are aligned vertically on each side of the loom, and said vertical runs move in opposite directions on each side of the loom when the cable is moved; a plurality of harness frames, each fixedly attached to a vertical run of each cable on each side of the loom, such that each harness will move freely up or down and remain parallel to its original horizontal position; a plurality of idler bars, which are shorter than the harnesses, each located beneath a harness, allowing the harnesses to be spaced closely together; each idler bar fixedly attached to a vertical run of each cable on each side of the loom, such that when each idler bar moves down, the harness attached to the same cable moves up; two pairs of harness-and-idler-bar stops, the first pair located below the harnesses and outside the shorter idler bars, the stops being located so that the harnesses normally sit on the stops with the shed being closed, the second pair of stops being located a distance below the idler bars and with the top surfaces angled, so that when the idler bars are pulled down, the harnesses rise until the idler bars come to rest against the stops; thus the harnesses are in the full open position with the rear harnesses being open further than the front harnesses; a plurality of treadles, pivotally mounted at the rear of the loom, and located beneath the idler bars; a treadle compensator, pivotally mounted on each treadle directly beneath the harnesses and idler bars; connecting cords, selectively connecting each treadle compensator to each idler bar, such that when a selected treadle is depressed, the harnesses will rise or remain stationary, as determined by the tie-up, and come to the full open position.

* * * * *